United States Patent [19]

Williams

[11] 4,396,896

[45] Aug. 2, 1983

[54] MULTIPLE COUPLED CAVITY WAVEGUIDE BANDPASS FILTERS

[75] Inventor: Albert E. Williams, Bethesda, Md.

[73] Assignee: Communications Satellite Corporation, Washington, D.C.

[21] Appl. No.: 56,375

[22] Filed: Jul. 10, 1979

Related U.S. Application Data

[63] Continuation of Ser. No. 866,132, Dec. 30, 1977, abandoned.

[51] Int. Cl.[3] ..... H01P 1/208; H01P 7/00

[52] U.S. Cl. ..... 333/212; 333/208

[58] Field of Search ..... 333/202-212, 333/227-233

[56] References Cited

U.S. PATENT DOCUMENTS 3,737,816 6/1973 Honicke ..... 333/209

3,969,692 7/1976 Williams et al. ..... 333/212

FOREIGN PATENT DOCUMENTS 2305036 10/1976 France ..... 333/212

OTHER PUBLICATIONS

G. Pfitzenmaier-"An Exact Solution for a Six-Cavity Dual-Mode Elliptic Band Pass Filter", 1977 IEEE Microwave Theory and Techniques International Symposium, San Diego, Calif., Jun. 21-23, 1977; pp. 400-403.

*Primary Examiner*—Marvin L. Nussbaum

*Attorney, Agent, or Firm*—Sughrue, Mion, Zinn, Macpeak & Seas

[57] ABSTRACT

The relative positions of the cavities in known single or dual mode multiple coupled cavity waveguide bandpass filters are rotated to achieve new filter structures in which the primary cavity couplings remain intact while the secondary couplings are shifted. The cavity rotation provides design flexibility since the input and output ports can now be taken from the same side of the filter structure. An additional advantage in dual mode filters is that the rotation permits the physical separation of input and output cavities, thereby providing increased isolation and eliminating spurious out-of-band coupling.

7 Claims, 9 Drawing Figures

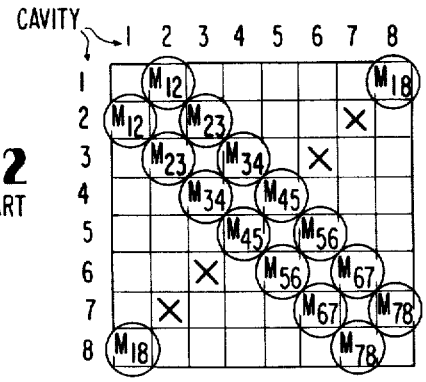
FIG. 2
PRIOR ART
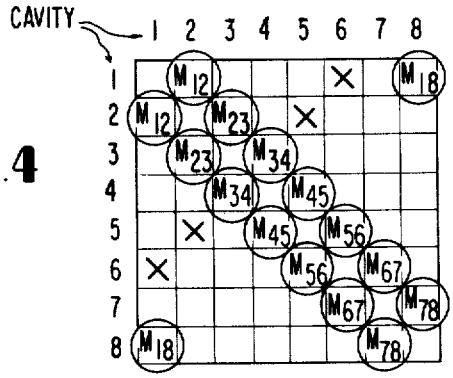
FIG. 4
FIG. 1a
PRIOR ART
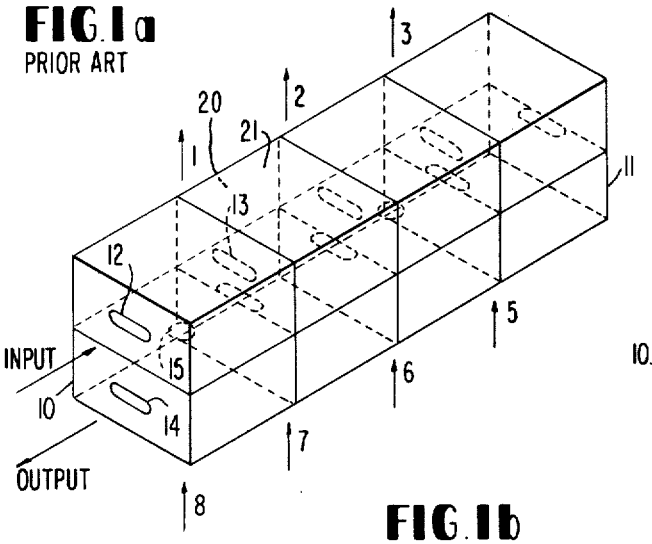
FIG. 3a
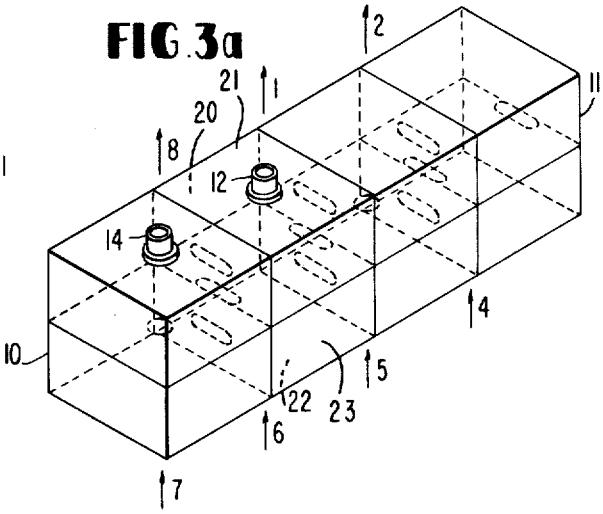
FIG. 1b
PRIOR ART
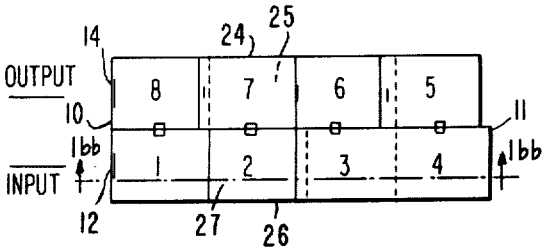
FIG. 3b
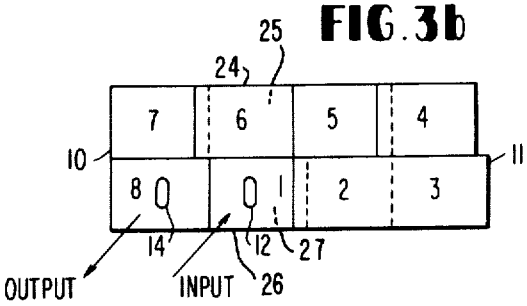
FIG. 1c
PRIOR ART
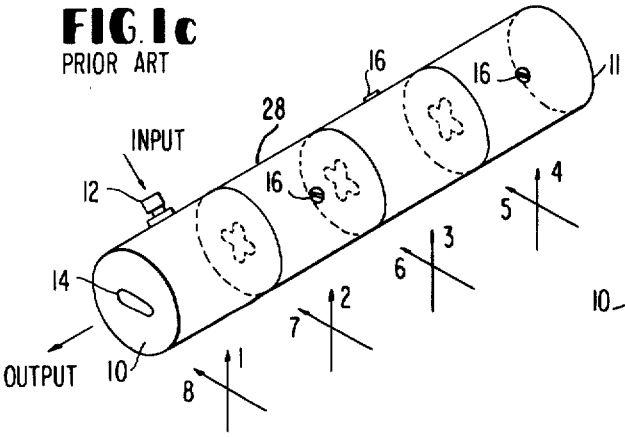
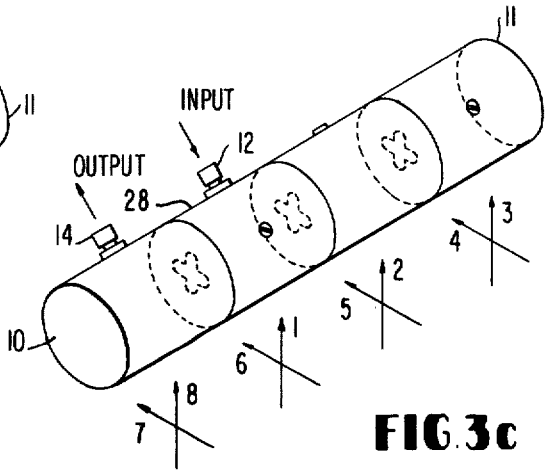
FIG. 3c

MULTIPLE COUPLED CAVITY WAVEGUIDE BANDPASS FILTERS

This is a continuation of application Ser. No. 866,132, filed Dec. 30, 1977, now abandoned.

BACKGROUND OF THE INVENTION

In my prior application, Ser. No. 736,603 entitled "Canonical Realization of Single Mode Waveguide Bandpass Filter", now abandoned, I disclosed a folded structure for a single mode waveguide bandpass filter which generates the canonical set of couplings i, i+1 for i=1 to (n−1) and realizes the general class of coupled cavity transfer frunctions (e.g., elliptic). Such a filter is illustrated in FIG. 1(*a*) herein. The filter structure includes n=2 m cavities each resonant in the fundamental $TE_{101}$ mode with input and output ports 12 and 14, respectively, provided at one end of the filter. Positive couplings are realized by magnetic coupling through slots 13 and negative coupling is achievd by circular holes 15. Note the canonical set of couplings i, i+1 for i=1 to (n−1) and the extra couplings 1 to n, 2 to n−1, 3 to n−2, etc. This coupling set represents the minimum possible number of couplings to achieve the general class of coupled cavity transfer functions.

In my prior application Ser. No. 616,479, now U.S. Pat. No. 3,969,692, I disclosed a circular $TE_{011}$ high Q mode multiple coupled cavity waveguide bandpass filter capable of realizing the general class of multiple coupled cavity filter transfer functions. Such a filter structure, shown in FIGS. 1(*b*) and 1(*bb*), includes a plurality of circular cavities resonant in the $TE_{011}$ mode with the input and output ports 12 and 14, respectively, at one end of the filter. This structure illustrates how negative couplings can be achieved in the high Q circular $TE_{011}$ mode by an end cavity overlay of one-half a diameter. It is important to note that this structure, which satisfies the canonical coupling geometry, allows the series couplings i, i+1 for i=1 to (n−1) and the extra couplings 1 to n, 2 to n−1, 3 to n−2, etc. By offsetting the fifth cavity by a half diameter with respect to the fourth cavity, the sign of the numeral 3-6 coupling is opposite the sign of the numeral 4-5 coupling and the general class of filter functions can thus be achieved.

In my prior application Ser. No. 754,804 entitled "Canonical Dual Mode Filter", and now U.S. Pat. No. 4,060,779. I disclosed a filter which is capable of realizing the general class of coupled cavity transfer functions with a 50% reduction in size and weight compared to the two above-mentioned filters. The dual mode filter, shown in FIG. 1(*c*) is composed of a plurality of cascaded cavities each resonating in two independent orthogonal modes and the use of a reflective plate at one end of the filter enables both input and output ports to be taken from the same physical cavity at the opposite end of the filter. Intercavity coupling is provided by coupling screws 16 and intracavity coupling is provided by polarity discriminating irises between the physical cavities. The structure shown in FIG. 1(*c*) allows coupling between cavities 1 and n, 2 and (n−1), etc., so that the general class of filter transfer functions may be achieved.

Although these filters have proven quite advantageous, each has encountered a common disadvantage in that the location of the input/output ports has been fixed. Since the input and output ports of the two single mode waveguide filters must be taken from one end of the filters, the design flexibility of systems utilizing those filters has been somewhat limited.

Similarly, the input and output ports of the dual mode waveguide filter must be taken from the same physical cavity at one end of the cascaded cavity structure and, as in the case with the single mode filters, this requirement on the location of the input/output ports has substantially limited the physical design flexibility of systems utilizing the dual mode filter. Furthermore, since the input/output ports are taken from the same physical cavity, spurious out-of-band coupling occurs and must be carefully controlled. For most practical purposes, this requires the use of a coaxial waveguide transition which results in substantial and extremely undesirable weight and volume increases.

It would be particularly advantageous to be able to locate the input and output ports of the single and dual mode filters at other positions around the periphery of the filter structure in order to provide increased system design flexibility. It would also be advantages to provide physically separate input and output cavities in the dual mode filter to increase isolation and eliminate spurious out-of-band coupling.

SUMMARY OF THE INVENTION

It is an object of this invention to provide a single mode filter structure in which the input and output ports may be taken from the same side of the filter structure.

It is a further object of this invention to provide a dual mode filter in which the input and output ports may be taken from the same side of the filter structure.

It is still a further object of this invention to provide such a dual mode filter in which the input and output cavities are physically separate.

Briefly, these and other objects are achieved by rotating the relative positions of the electrical cavities in the above-described filter structures so that the input and output porst may be taken from adjacent cavities on the side of the filter structure.

BRIEF DESCRIPTION OF THE DRAWINGS

FIG. 2 is a coupling matrix illustrating the cavity couplings in the filter structures illustrated in FIGS. 1(*a*) to 1(*c*);

FIGS. 3(*a*) to 3(*c*) show the filter structures of FIGS. 1(*a*) to 1(*c*), respectively, after rotation of the electrical cavities according to the present invention; and FIG. 4 is a coupling matrix illustrating the cavity couplings of the filter structures shown in FIGS. 3(*a*) to 3(*c*).

DETAILED DESCRIPTION OF THE INVENTION

Figure 1B:
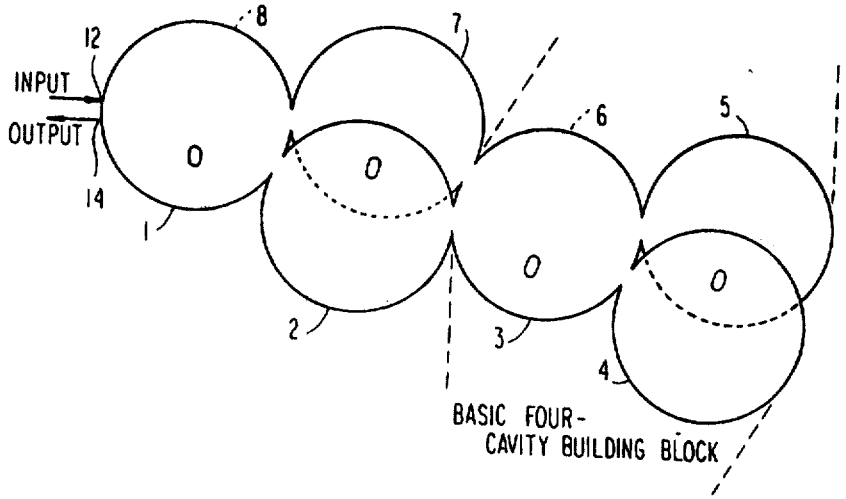
FIGS. 1(*a*) to 1(*c*) show known multiple coupled cavity filter structures, with FIG. 1(*bb*) being a view along lines BB—BB in FIG. 1(*b*)

A description of the present invention will be given for filter structures having eight (8) electrical cavities, however, it will be obvious to one of ordinary skill in the art that the present invention is equally applicable to any filter structure having n=2 m cavities.

To realize the optimum filter response, a direct coupled cavity structure must preserve the series cavity couplings 1-2, 2-3, 3-4, 4-5, 5-6, 6-7, 7-8, and the 1-8 (1-n) coupling. These couplings are indicated as circles in the coupling matrix of FIG. 2 and hereinafter will be referred to as primary couplings. For the case of eight cavities, two other couplings are required in order to realize the optimum filter response and these couplings lie on the anti-diagonal of the matrix at 2-7 and 3-6. These couplings are indicated as X in FIG. 2 and will hereinafter be referred to as the secondary couplings. The cavity couplings illustrated in FIG. 2 are those utilized in the canonical waveguide filters illustrated in FIGS. 1(*a*) to 1(*c*), discussed above.

It has been found that rotation of the electrical cavities in the above-described filter structures by, for example, one position in a clockwise direction, the primary couplings will be maintained but the secondary couplings 2-7 and 3-6 will be shifted to 1-6 and 2-5. These new structures are shown in FIGS. 3(*a*) to 3(*c*) and the coupling matrix illustrating the cavity couplings in these new filter structures is shown in FIG. 4. The coupling matrix of FIG. 4 is asymmetrical since the secondary couplings are no longer located on the anti-diagonal of the matrix, but the same optimum filter response is achieved. The input is in cavity 1 and the output in cavity 8 and both are taken from the same side of the filter at one end. It should be noted here that for the purposes of this description the cavities in FIGS. 1(*a*) to 1(*c*) and 3(*a*) to 3(*c*) are regarded as being arranged end-to-end so that surfaces 10 and 11 represent the "ends" of the filter structure and surfaces 20–28 represent the "sides" of the structure. In other words, the "ends" of the illustrated structures are those two surfaces of the filter structure separated by the largest number of cavities, while the remaining surfaces are the "sides". These new structures allow additional flexibility in the design of systems utilizing waveguide filters.

Note that, in the filter structures shown in FIGS. 1(*a*) and 1(*b*), the end cavities, whereas the intermediate or side cavities 2, 3, 5 and 6 are each coupled through aperture 13 to cavity 2 and through aperture 15 to cavity 8, but side cavity 2 is coupled through apertures on either side thereof to both adjacent cavities 1 and 3, and is coupled through an aperture in the bottom thereof to cavity 6. This can also be seen from the coupling matrix shown in FIG. 2 where cavities 1, 4, 5 and 8 are each shown as having only two couplings while the remaining cavities each have three. This coupling configuration is necessary in order to achieve the desired filter transfer function. Thus, one way of distinguishing between the end and side cavities of the filters shown in FIGS. 1(*a*) and 1(*b*) is to describe the end cavities as being those cavities which are coupled to k other cavities, while the side cavities are coupled to k+1 other cavities, where k=1.

In the filter shown in FIG. 1(*c*), each physical cavity doubles as two electrical cavities. However, as is clear from the figure, the physical cavities at either end of the filter structure are each coupled to only one adjacent physical cavity while the two intermediate cavities are each coupled to two other cavities. Further, the filter structure of FIG. 1(*c*) has the same coupling matrix shown in FIG. 2 in which cavities 1, 4, 5 and 8 are each coupled to only two other electrical cavities while the remaining electrical cavities are each coupled to three other electrical cavities. Thus, the end and side cavities in the filter structure shown in FIG. 1(*c*) can likewise be distinguished by defining the end cavities as being those cavities which are coupled to k other cavities while the side cavities are coupled to k+1 other cavities.

The disadvantage of the asymmetrical coupling matrix is that the dimensions of each coupling slot must be computed separately, whereas with a symmetrical coupling matrix, several of the coupling slots, e.g., the 1-2 and 7-8 slots, are identical so that the number of necessary computations is reduced. Nevertheless, the new filter structures according to the present invention are highly advantageous in systems where space limitations require that both input and output ports be taken from the same side of the filter structure.

Rotation of the cavities in a counter-clockwise direction will produce a result similar to that shown in FIGS. 3(*a*) thru 3(*c*) with the input and output ports on the opposite side of the filter and such filters would also provide the optimum filter response. If the cavities are rotated more than one position while maintaining the same set of primary couplings, the resulting filter structures will no longer exhibit the optimum filter response and, thus, no new filter realizations are achieved by additional cavity rotation. It should be noted, however, that rotation of the cavities by (m−1) positions in a clockwise direction would result in a filter structure and corresponding filter response identical to those achieved by rotating the cavities one position in a counter-clockwise direction. Also, rotation by (m−1) positions in a clockwise direction is tantamount to a one position clockwise rotation.

Other coupling matrix forms can be achieved from the basic form shown in FIG. 4 by merely interchanging the rows and columns of the coupling matris and/or by changing the signs of the rows and columns as is well known in the art. The rotation of the cavities can be performed with any even order cavity set to achieve new physical filter structures having the same transfer function. This provides added flexibility in the physical design of systems utilizing such filters and, in the case of the dual mode filter shown in FIG. 3(*c*), filter performance is improved since the location of the input and output ports in separate physical cavities provides increase isolation and eliminates spurious out-of-band coupling.

The rotation of the relative positions of the electrical cavities in the filter structure shown in FIG. 1(*a*) leads to new filter structures suitable for use by any type of single moded resonant cavity, e.g., waveguide, coaxial or microstrip, etc. Similarly, the rotation of the relative positions of the electrical cavities in the filter structure shown in FIG. 1(*b*) leads to new filter structures for the general high Q circular $TE_{011}$ mode waveguide filter. Finally, rotation of the relative positions of the electrical cavities in the filter structure shown in FIG. 1(*c*) leads to new filter structures suitable for use by cavities which are resonant in any orthogonal modes such as $TE_{111}$ circular, $TE_{101}$ square or $TE_{211}$ square, etc.

What is claimed is:

1. A plural cavity filter comprising a plurality of n cascaded cavities, including end cavities each coupled to k other cavities and side cavities each coupled to (K+1) other cavities, said filter having an input port and an output port wherein the improvement comprises both said input port and said output port being taken from adjacent cavities on the same side of the filter with at least one of said input and output ports being taken from a side cavity.

2. A plural cavity filter according to claim 1, wherein the input and output ports are taken from the last two cavities at one end of the filter structure i.e., only one of said input and output ports is taken from a side cavity.

3. A plural cavity filter according to claim 2, wherein n=2 m and m is a positive interger.

4. A plural cavity filter according to claim 3 wherein said filter is a single mode waveguide filter comprising n waveguide cavities each resonant in a single mode at a common center frequency and arranged in two adjacent cascaded sections of m cavities each, adjacent cavities in the same section and adjacent cavities in different sections being coupled through apertures in their common cavity walls.

5. A plural cavity filter according to claim 4, wherein said cavities are cylindrical cavities.

6. A plural cavity filter according to claim 4, wherein said cavities are rectangular.

7. A plural cavity filter according to claim 2, wherein each cavity resonates at its resonant frequency in first and second independent orthogonal modes, said filter having coupling means within each cavity for intracavity coupling of said first and second modes and apertures in the common walls between adjacent cavities for coupling like oriented modes in adjacent cavities.

* * * * *